United States Patent [19]

Duling et al.

[11] 4,046,703

[45] Sept. 6, 1977

[54] TRACTION FLUIDS

[75] Inventors: Irl N. Duling, West Chester; David S. Gates, Swarthmore, both of Pa.

[73] Assignee: Sun Oil Company of Pennsylvania, Philadelphia, Pa.

[21] Appl. No.: 635,561

[22] Filed: Nov. 26, 1975

Related U.S. Application Data

[60] Division of Ser. No. 598,619, July 23, 1975, abandoned, which is a division of Ser. No. 163,543, July 15, 1971, abandoned, which is a continuation-in-part of Ser. No. 679,833, Nov. 1, 1967, Pat. No. 3,595,796.

[51] Int. Cl.[2] ..... C10M 1/16; C10M 3/10; C10M/5/08; C10M/7/12

[52] U.S. Cl. ..... 252/59; 74/200; 252/73

[58] Field of Search ..... 252/73, 59; 74/200

[56] References Cited

U.S. PATENT DOCUMENTS

| | | | |
|---|---|---|---|
| 3,411,369 | 11/1968 | Hammann et al. | 74/200 |
| 3,595,796 | 7/1971 | Duling et al. | 252/73 |
| 3,843,537 | 10/1974 | Duling et al. | 252/73 X |
| 3,975,278 | 8/1976 | Wygant | 252/59 |

*Primary Examiner*—Delbert E. Gantz
*Assistant Examiner*—Irving Vaughn
*Attorney, Agent, or Firm*—J. Edward Hess; Donald R. Johnson; Paul Lipsitz

[57] ABSTRACT

Perhydrogenated dimers of styrene or a methylated styrene have very high coefficients of traction and are therefore useful as traction fluids. A preferred dimer is 1-cyclohexyl-1,3,3-trimethylhydrindane.

4 Claims, No Drawings

TRACTION FLUIDS

CROSS REFERENCE TO RELATED APPLICATIONS

This application is a division of Ser. No. 598,619, filed July 23, 1975 (now abandoned) which is a division of Ser. No. 163,543, filed July 15, 1971 (now abandoned) which is a continuation-in-part of Ser. No. 679,833, filed Nov. 1, 1967, now U.S. Pat. No. 3,595,796.

BACKGROUND OF THE INVENTION

U.S. Pat. No. 3,440,894 to Hammann et al. contains a good description of traction and the tractive drives to which our invention pertains.

As stated therein, traction is broadly defined as the adhesive friction of a body on a surface on which it moves. Tractive devices, as considered in light of the present invention, are those devices in which torque is transmitted through nominal point or line contact, typically with a rolling action. Although sometimes referred to as friction drives, such devices are more appropriately described as tractive drives. A tractive drive, in simplified form, could comprise two parallel cylindrical rollers in tangential contact, one roller being the input member and the other the output member. The torque capacity of such a tractive drive is a direct function of the contact pressure between the rollers and the coefficient of traction of the roller surfaces. The phrase "coefficient of traction" is preferred instead of "coefficient of friction" in order to connote rolling contact.

The traction existing at the rolling contacts of ball and roller bearings, although considered detrimental in most applications, can be used to transmit tangential force. If the coefficient of traction and the normal load on the rolling bodies are sufficient to prevent slipping, any ball or roller bearing can serve as a prototype of a tractive drive.

As further stated by Hammann et al. a distinguishing feature of tractive drives is that torque is generally transmitted therein from one member to another member by traction generated through nominal point or line contact. This is in contrast with a true friction drive such as an automotive friction clutch or a belt drive where torque is transmitted through area contact. When point contact or line contact are referred to herein; the term nominal is employed to signify that the actual contact area is something greater than that of a point or a line.

Also, as stated by Hammann et al, to further distinguish tractive drives from friction drives, consider the definition of friction. Friction is defined as the resistance to relative motion between two bodies in contact. In friction drives, a high resistance to relative motion is desired. Thus, advantage is taken of the resistance to relative motion of two or more bodies in contact to provide means for transmitting torque. In friction drives, therefore, it is desirable, under stabilized speed conditions, to have a high coefficient of friction, thus minimizing or avoiding any rolling or sliding contact between members; whereas, tractive drives, as defined above, intentionally incorporate some form of relative motion between the load carrying members, and this relative motion is not in the form of slippage. A familiar example of a friction drive comprises an input member and an output member having mating wedged surfaces wherein the surface material possesses a high coefficient of friction. The surface material can be fiber, asbestos, leather, etc. Increased torque capacity is achieved therein by tighter wedging of the members, the latter being engaged with area contact and having no slippage or relative motion therebetween.

Dimers of styrene or methylated styrenes (where the methyl group is on the side chain or the ring) are well known. See for example Hammann et al. U.S. Pat. No. 3,411,369 which discloses a hydrogenated cyclic dimer of a α-methylstyrene as a traction fluid. Stahly U.S. Pat. No. 3,272,879 has an incidental disclosure of such dimers as power transmission fluids although the term power transmission fluids covers a large multitude of applications in all of which the traction characteristics of the fluid are irrelevant, such as power steering, automatic transmissions, fluid drives, rotary vane pumps, power brakes, aircraft landing gears, industrial presses, excavating equipment and so on. F. G. Rounds in JOURNAL OF CHEMICAL AND ENGINEERING DATA, October 1960, Vol. 5, No. 4, pgs. 499 et seq. discloses naphthenic mineral oils as having better friction characteristics than paraffinic or mixed oils. However, the author points out that he was unable to relate friction characteristics with specific hydrocarbons.

SUMMARY OF THE INVENTION

The present invention is a method of improving the coefficient of traction between two surfaces in tractive relationship. The invention involves introducing a perhydrogenated dimer of styrene or methylstyrene to the surfaces.

DESCRIPTION OF THE INVENTION

The dimerization of styrene and methylstyrenes has been known for many years. See for example U.S. Pat. Nos. 3,595,796; 3,595,797; 3,597,358; 3,272,879; 3,523,981; 3,161,692 and JACS, Vol. 80, pgs. 1938–41.

In general, the dimerization produces cyclic products or linear products. Regarding cyclic products α-methylstyrene produces (after hydrogenation) 1-cyclohexyl-1,3,3-trimethylhydrindane, styrene products 1-cyclohexyl-3-methylhydrindane and other methylated styrenes produce analogous products. The linear products produced are formed by the α-carbon atoms joining and/or by the benzene ring of one joining with the α-carbon of the other. The linear products produced (after hydrogenation) are 2,3-dicyclohexylbutane and 1-cyclohexyl-1-(p-ethylcyclohexyl)-ethane from styrene, 2-methyl-2,4-dicyclohexylpentane and 2-cyclohexyl-2-(p-propylcyclohexyl) propane from α-methylstyrene and analogous products from other methylstyrenes. It will be thus apparent that the perhydrogenated cyclic dimers are hydrindanes with a cyclohexyl and 1–3 methyl substituents and the perhydrogenated linear dimers are $C_2$-$C_6$ alkanes with two cyclohexyl substituents. Preferred are the dimers of α-methylstyrene, preferably the cyclic dimer.

The formation of mainly cyclic or linear dimers depends on the reaction conditions employed. See for example Ipatieff et al. U.S. Pat. No. 2,514,546 for a cyclic procedure and Ipatieff at al. U.S. Pat. No. 2,622,110 for a linear procedure. Other procedures are also well known.

Hydrogenation of the dimer is readily accomplished by treatment with hydrogen at 2,000 -10,000 p.s.i. and 200°C in the presence of Raney nickel catalyst.

The dimers of the invention are liquids and have a KV (210°F) of 1.5–200, preferably 3–20. They boil above 100°C and below 500°C. They can contain additives such as pour point depressants, antiwear agents, detergents, VI improves, defoamers and the like. Antiwear agents such as zinc dithiophosphate are especially useful since the dimers of the invention are not "lubricants" in the usual sense of the word and an additive is necessary to get reasonable life of the tractive drive. Examples of traction drives in which our dimers are useful are shown in FIGS. 1 and 2 of U.S. Pat. No. 3,595,797 and also the patents referred to in Col. 2, lines 46–56 of that patent. The following examples illustrate the invention more specifically. The traction coefficients were obtained by the test procedure and apparatus described by F. G. Rounds, JOURNAL OF CHEMICAL AND ENGINEERING DATA, Vol. 5, No. 4, pgs. 499–507 (1960) employing two steel thrust ball bearings and requiring 170 ml. of lubricant, by measuring the torque transmitted through the bearings as a function of load, speed and oil temperature.

EXAMPLE I 466 g. of a commercial α-methylstyrene polymer obtained by conventional acid-catalyzed polymerization, is placed in a 1 -liter round bottomed flask, attached to a one-inch column, and dry distilled with essentially no reflux or fractionation at a pot temperature of about 290°C, and a vapor temperature of about 210°C under a vacuum of about 6 millimeters of mercury. 373 g. of distillate are obtained and about 73 grams of material remain in the bottom of the flask at the end of the distillation. The commercial α-methylstyrene polymer has a softening point of 210°F, a Gardner-Holdt viscosity of J-L, a specific gravity of 1.075, a refractive index at 20°C of 1.61, a molecular weight of 685, an iodine number of 0, an acid number of 0 and a saponification number of 0.

EXAMPLE II 300 g. of the distillation product of Example I are placed in a 316 stainless steel bomb along with 7.5 grams of Raney nickel catalyst and the bomb is pressured to 3000 p.s.i.g. of 100% hydrogen while heat as applied until the temperature in the bomb is 150°C. At that point an exothermic reaction occurs and heating is discontinued. The temperature is allowed to rise to about 200°C and the hydrogen pressure is maintained at3000 p.s.i. for 6 hours at which time the bomb is slowly cooled to ambient temperature while maintaining the hydrogen pressure at 3000 p.s.i. in order to avoid dehydrogenation of the hydrogenated product. The resulting perhydrogenated poly(α-methylstyrene) oil is topped to remove components boiling below 125°C. Analysis by nuclear magnetic resonance (NMR) shows the oil of this example to contain about 20% of trimers (mostly hydrindan), about 10% of 2,5-(dicyclohexyl)-2-methylpentane, and about 70% of 1,1,3-trimethyl-3-cyclohexylhydrindane. The properties of the remaining perhydrogenated product are as follows:

| | Coefficient of traction | | | | | | | | |
|---|---|---|---|---|---|---|---|---|---|
| | 100 ft./m. | | | | | 600 ft./m. | | | |
| Press., psi<br>Temperature | 300,000<br>200° F | 400,000<br>400° F | 400,000<br>200° F | 400,000<br>300° F | 500,000<br>200° F | 400,000<br>200° F | KV, 210° F | ASTM Viscosity Index | Pour Point (° F) |
| | 0.30 | .052 | .053 | .048 | .049 | .056 | 5.5 | −46 | −5 |

EXAMPLE III

The procedures of Examples I and II are repeated except that styrene is employed instead of α-methylstyrene. Results are analogous with 55% of the product being dimer, the balance trimer. The product has a KV at 210°F of 3.30, an ASTM VI of 26, and a −40°F pour point. It has a coefficient of traction (same test as above) of 0.047 (500,000 p.s.i., 200°F).

EXAMPLE IV

Below are traction coefficients of ASTM Oil 3 (standard naphthenic lube) and hydrogenated ASTM Oil 3, the latter being included because it is known that hydrogenation of α-methylstyrene dimer improves its traction coefficient and it was thought that even though ASTM Oil 3 does not contain α-methylstyrene dimer hydrogenation might still give an improvement.

| | Coefficient of traction | | | | | | |
|---|---|---|---|---|---|---|---|
| | 100 ft./m. | | | | | 600 ft./m. | |
| Press, psi<br>Temperature | 300,000<br>200° F | 400,000<br>100° F | 400,000<br>200° F | 400,000<br>300° F | 500,000<br>200° F | 400,000<br>200° F | KV 210° F |
| ASTM Oil 3 | .016 | .040 | .037 | .035 | .042 | .042 | |
| Hydrogenated ASTM Oil 3 | .019 | .046 | .042 | .037 | .042 | .045 | |

It is apparent from the above that dimers of styrene and methylstyrenes have very high traction coefficients. Using the test procedure in Hammann et al. U.S. Pat. No. 3,440,894 (200°F, 400,000 p.s.i., 750 ft/min), the coefficient of traction of our preferred 1-cyclohexyl-1,3,3-trimethylhydrindane is 0.074 (0.054 by the method of Rounds) so it will be apparent that this material is superior to almost all the materials disclosed by Hammann et al. in this patent and also Hammann et al. U.S. Pat. No. 3,411,369.

The invention claimed is:

1. Method of increasing the coefficient of traction between two surfaces in tractive relationship which comprises introducing to said surfaces a perhydrogenated dimer of styrene or a methylstyrene.

2. Method according to claim 1 wherein said dimer is a dimer of α-methylstyrene.

3. Method according to claim 2 wherein said perhydrogenated dimer is 1-cyclohexyl-1,3,3-trimethylhydrindane.

4. Method according to claim 1 wherein said perhydrogenated dimer contains an antiwear additive.

* * * * *